US007578290B2

(12) United States Patent
Mitchell

(10) Patent No.: US 7,578,290 B2
(45) Date of Patent: Aug. 25, 2009

(54) BREECH LOADED SOFT PROJECTILE BLOW GUN

(75) Inventor: Jeffrey R. Mitchell, Tallahassee, FL (US)

(73) Assignee: Growth Innovations, Tallahassee, FL (US)

( * ) Notice: Subject to any disclaimer, the term of this patent is extended or adjusted under 35 U.S.C. 154(b) by 264 days.

(21) Appl. No.: 11/492,369

(22) Filed: Jul. 25, 2006

(65) Prior Publication Data

US 2008/0022989 A1 Jan. 31, 2008

(51) Int. Cl.
*F41B 1/00* (2006.01)
*F41B 11/00* (2006.01)

(52) U.S. Cl. ..... 124/62; 124/56; 124/63

(58) Field of Classification Search ..... 124/62, 124/56, 63
See application file for complete search history.

(56) References Cited

U.S. PATENT DOCUMENTS

| | | | | |
|---|---|---|---|---|
| 286,513 | A | 10/1883 | Wengenroth | |
| 341,884 | A | 5/1886 | Colby | |
| 429,499 | A | 6/1890 | Bunsen | |
| 477,322 | A | 6/1892 | Bunsen | |
| 1,009,063 | A | 11/1911 | Gilchrist | |
| 1,084,599 | A | 1/1914 | Ballentine | |
| 1,290,050 | A | 1/1919 | Bay et al. | |
| 1,545,794 | A | 7/1925 | Quinn | |
| 3,137,287 | A | 6/1964 | De Arbun | |
| 3,190,654 | A | 6/1965 | Ross | |
| 3,790,085 | A * | 2/1974 | Ayer | 239/291 |
| 4,054,120 | A | 10/1977 | Foley | |
| 5,850,826 | A * | 12/1998 | Guthrie | 124/62 |
| 6,901,922 | B2 * | 6/2005 | Forti et al. | 124/62 |
| 6,904,901 | B2 * | 6/2005 | Mitchell | 124/65 |
| 2004/0200465 | A1 * | 10/2004 | Forti et al. | 124/62 |
| 2004/0255921 | A1 * | 12/2004 | Mitchell | 124/45 |
| 2006/0042615 | A1 * | 3/2006 | Gregory | 124/62 |
| 2006/0180133 | A1 * | 8/2006 | Mitchell | 124/20.1 |

OTHER PUBLICATIONS

Marshmallowville.com, Dec. 4, 2005, http://www.marshmallowville.com/presskit/BlowerHighRes.jpg.*

Perpetual Kid-Entertain Your Inner Child-Marshmallow Blower, Nov. 1, 2005, http://www.perpetualkid-blog.com/2005/11/marshmallow_blo.html.*

(Continued)

*Primary Examiner*—Bret Hayes
*Assistant Examiner*—Michael D David
(74) *Attorney, Agent, or Firm*—J. Wiley Horton

(57) ABSTRACT

A blow gun for launching soft projectiles. The blow gun includes an action sleeve which is wrapped around and attached to a receiver. Soft projectiles, such as marshmallows, may be loaded into the breech of the blow gun by rotating the action sleeve approximately a quarter of a turn around the receiver. When rotated in this manner, a loading port in the action sleeve aligns with a corresponding loading port on the receiver, thus exposing the hollow interior of the receiver. A barrel is attached to one end of the receiver so that the hollow interior of the barrel and the hollow interior of the receiver are aligned. A muzzle brake extends beyond the barrel and has a plurality of brake vents to prevent the accidental inhalation of projectiles when inhaling on the muzzle end of the blow gun. The blow gun may be fired by blowing into a blow tube which is fluidly connected with the receiver.

16 Claims, 4 Drawing Sheets

OTHER PUBLICATIONS

New Line of Marshmallow Toys are Right on Target, Feb. 19, 2005, http://www.marshmallowville.com/downloads/MFC_Press_Release.pdf.*

American International Toy Fair 2005 in New York, Dipika Mirpuri, Feb. 20, 2005, http://toys.about.com/od/hotnewtoyreleases/a/toyfair2005.htm.*

* cited by examiner

BREECH LOADED SOFT PROJECTILE BLOW GUN

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of soft projectile launching toys. More specifically the present invention comprises a soft projectile blow gun with a breech loading mechanism for loading soft projectiles in the blow gun, and a muzzle brake for preventing accidental inhalation of the soft projectile.

2. Description of the Related Art

Projectile launchers have long been known as novelty items. These launchers typically fire potatoes, vegetable slices, marshmallows, tennis balls, and the like. Some are spring loaded, while others use a charge of air. They typically fire a small projectile which can be used in "mock combat" games without actually injuring the target. These devices have also found application other than as novelty items. Some have been used to fire marking projectiles in the veterinary and timber industries. Others have been used as pill injectors for treating horses and cows. Thus, although such projectile launchers are most often viewed as novelty items, their applications may be much broader.

Many individuals enjoy using lung-powered projectile launchers, weapons commonly referred to as "blow guns," when engaging in mock combat. Blow guns are usually very simple weapons. When using a blow gun, the user blows in a mouthpiece or blow tube which is fluidly connected with a conduit. The projectile is pushed through the conduit and out the end by the charge of air generated by the user. The user can control the distance of the projectile based on how hard the user blows.

The accidental inhalation of projectiles from blow guns is a growing concern in the industry. There are two ways that the projectile can be inhaled. Sometimes a user will take a deep breath to create a large pressure charge. If the user's mouth is too close to the mouthpiece when the user takes the deep breath, the user may inadvertently suck the projectile out of the gun through the blow tube or mouth piece. It is also common, particularly for children, to inadvertently inhale the projectile out the muzzle end of the barrel. In the current legal climate, many toy manufactures have stopped making and selling blow guns because of these choking hazards. Accordingly, it would be beneficial to provide a soft projectile blow gun with safety features that mitigate these risks.

BRIEF SUMMARY OF THE INVENTION

The present invention comprises a blow gun for launching soft projectiles. The blow gun includes an action sleeve which is wrapped around and attached to a receiver. Soft projectiles, such as marshmallows, may be loaded into the breech of the blow gun by rotating the action sleeve approximately a quarter of a turn around the receiver. When rotated in this manner, a loading port in the action sleeve aligns with a corresponding loading port on the receiver, thus exposing the hollow interior of the receiver. A soft projectile may be placed in the hollow interior of the receiver, and the action sleeve is rotated back to its starting position. The blow gun is then ready to fire.

A barrel is attached to one end of the receiver so that the hollow interior of the barrel and the hollow interior of the receiver are aligned. A muzzle brake extends beyond the barrel. It has a plurality of brake vents to prevent the accidental inhalation of projectiles when inhaling on the muzzle end of the blow gun. The blow gun may be fired by blowing into a blow tube which is fluidly connected with the receiver.

REFERENCE NUMERALS IN THE DRAWINGS

| | | | |
|---|---|---|---|
| 10 | blow gun | 12 | tube |
| 14 | loading grip | 16 | receiver |
| 18 | action sleeve | 20 | stationary grip |
| 22 | handle | 24 | spigot |
| 26 | spigot slot | 28 | loading port |
| 30 | barrel | 32 | muzzle brake |
| 34 | brake vents | 36 | flow constrictor |
| 38 | loading chamber | 40 | receiver port |
| 42 | "O" rings | 44 | "O" ring guides |
| 46 | lip | 48 | spigot port |
| 50 | soft projectile | | |

DETAILED DESCRIPTION OF THE INVENTION

Figure 1:
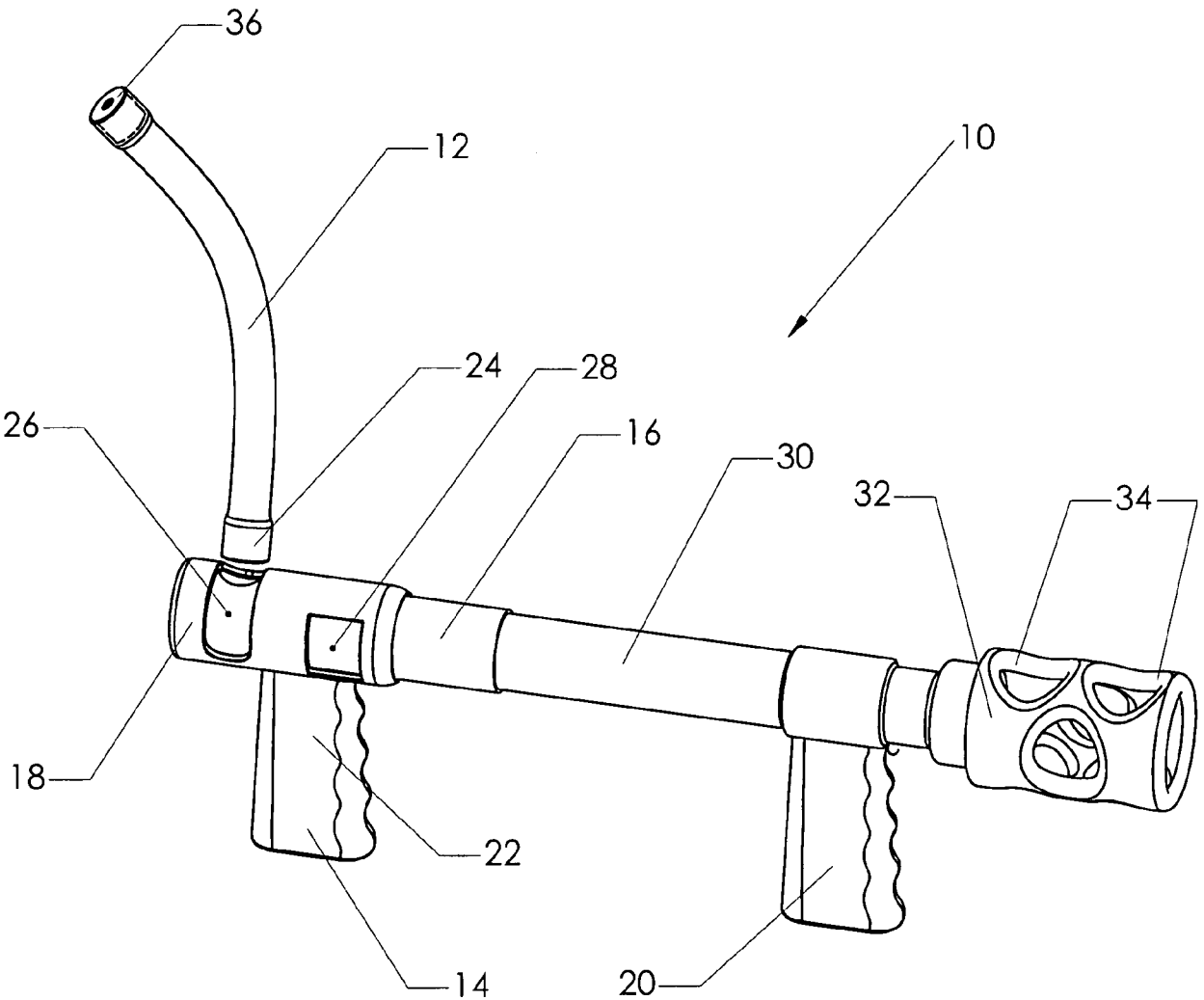
FIG. 1 is a perspective view, showing the present invention

The preferred embodiment of the present invention, blow gun 10, is illustrated in FIG. 1. Blow gun 10 includes loading grip 14 which is wrapped around and attached to receiver 16. Soft projectiles, such as marshmallows, may be loaded into the breech of blow gun 10, by rotating loading grip 14 approximately a quarter of a turn with respect to receiver 16. When rotated in this manner, action sleeve 18 rotates around the exterior of receiver 16 and loading port 28 aligns with a corresponding loading port on receiver 16 exposing the hollow interior of receiver 16. A soft projectile may be placed in the hollow interior of receiver 16, and then loading grip 14 is rotated back to its starting position. When loading grip 14 is in its original position as shown in FIG. 1, blow gun 10 is loaded and ready to fire.

Barrel 30 is attached to one end of receiver 16 so that the hollow interior of barrel 30 and the hollow interior of receiver 16 are aligned and fluidly connected. Stationary grip 20 is attached near one end of barrel 30. Stationary grip 20 assists the user in loading and aiming blow gun 10. A right-handed shooter rotates loading grip 14 around receiver 16 by holding stationary grip 20 in the shooter's left hand and manipulating handle 22 angularly around receiver 16 with the shooter's right hand. This keeps receiver 16 in a stationary orientation when loading grip 14 is rotated. Muzzle brake 32 is also provided at the end of barrel 30. Muzzle brake 32 extends beyond barrel 30 and has a plurality of brake vents 34. This feature prevents the user from placing the user's mouth around the muzzle of the projectile launcher and inhaling the soft projectile. Brake vents 34 prevent the user from creating suction on the muzzle. If the user inhales through the end of muzzle brake 32, air will pass through brake vents 34. No vacuum will be created in the barrel.

To fire blow gun 10, the user simply blows tube 12 when blow gun 10 is loaded. Flow constrictor 36 is provided within tube 12 and prevents projectiles from being accidentally pulled back through tube 12 when the user inhales. Other mechanisms may also be provided to prevent objects from passing through the conduit of tube 12, including plastic or mesh filters.

Tube 12 is attached to receiver 16 with spigot 24. Spigot 24 projects outward from the exterior of receiver 16 transversely to the central axis of receiver 16. Spigot slot 26 is provided in action sleeve 18 and permits action sleeve 18 to angularly rotate about the central axis of receiver 16 over a fixed angle and distance.

Figure 2:
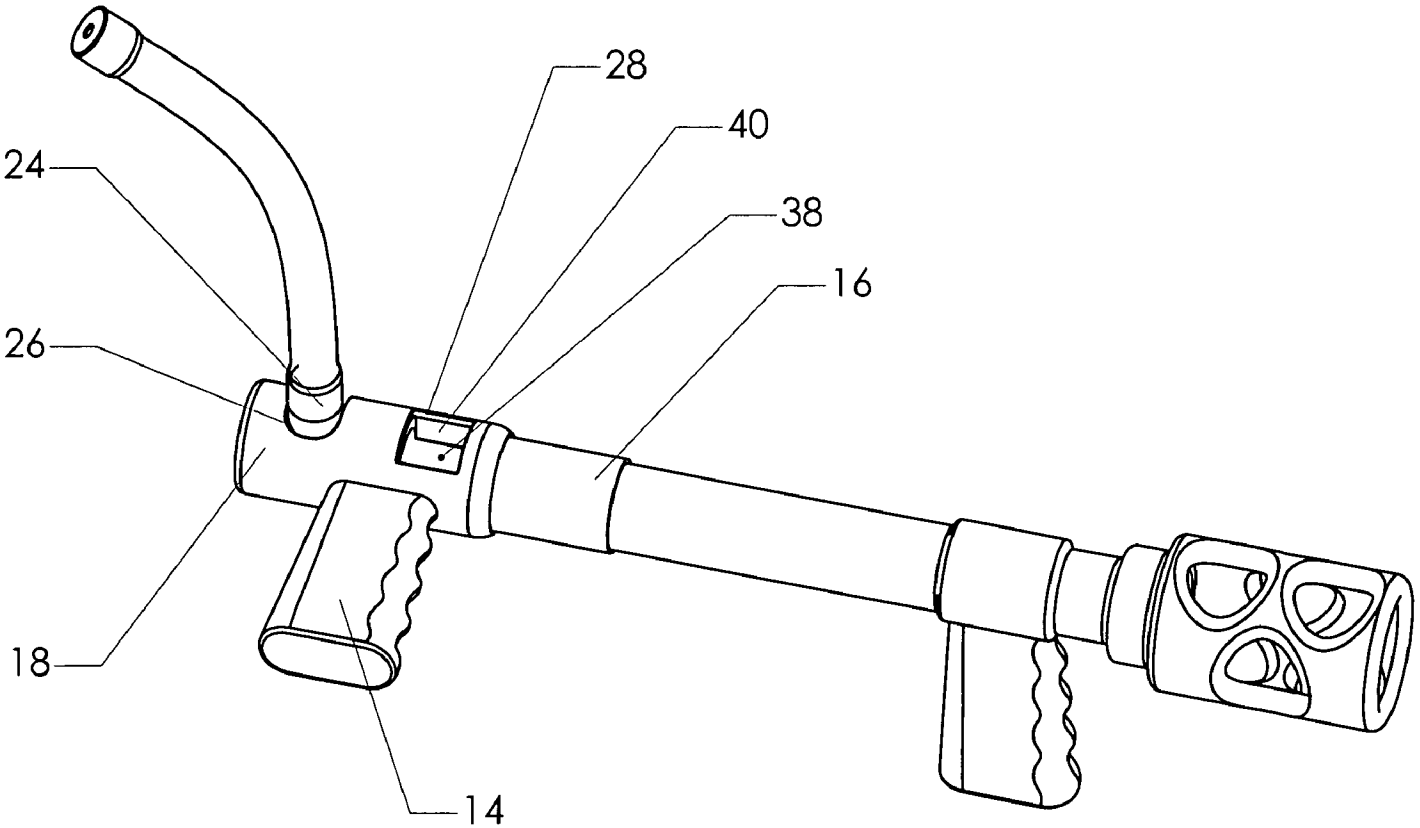
FIG. 2 is a perspective view, showing the present invention.

Blow gun 10 is shown in the loading position in FIG. 2. When loading grip 14 is rotated approximately a quarter of a turn with respect to receiver 16 (with the lower portion rotating toward the viewer in FIG. 2), loading port 28 of action sleeve 18 and receiver port 40 of receiver 16 are aligned. Loading chamber 38 is then visible. Spigot slot 26 makes contact with spigot 24 when loading port 28 aligns with receiver port 40. This contact arrests the motion of loading grip 14. The user may then place a soft projectile into loading chamber 38. Once loaded, the user rotates loading grip 14 back to the ready-to-fire position.

Figure 3:
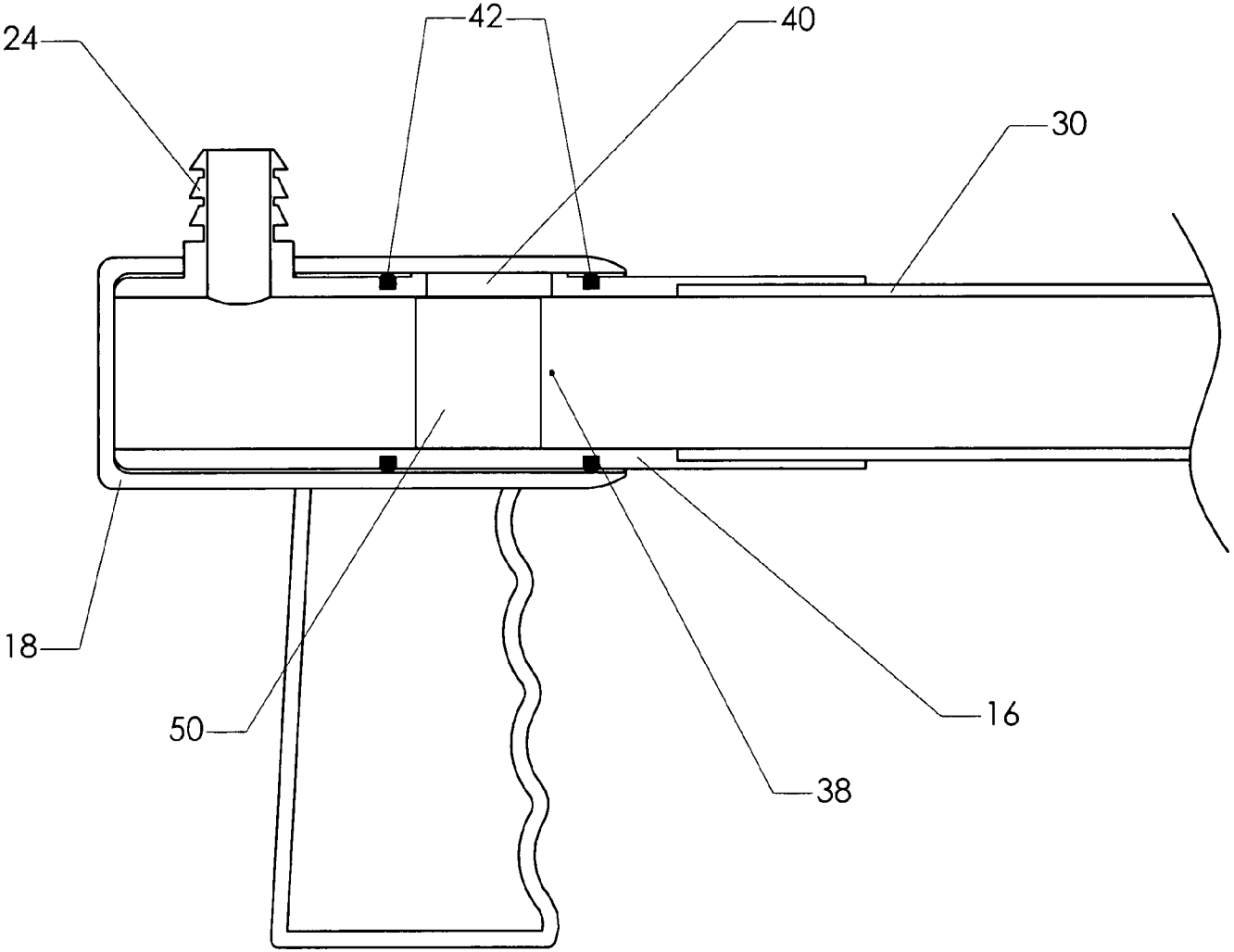
FIG. 3 is a section view, showing the present invention.

A section view of blow gun 10 in the ready-to fire state is provided in FIG. 3. The reader will note when the user blows through tube 12 a charge of air passes through spigot 24 into loading chamber 38, causing soft projectile 50 to launch through barrel 30 and out of blow gun 10. "O" ring 42 is placed on both sides of receiver port 40 between receiver 16 and action sleeve 18. "O" rings 42 create an air-tight seal between action sleeve 18 and receiver 16. The reader will note that "O" rings 42 are compressed between action sleeve 18 and receiver 16. The compression makes the plastic to plastic seal both dynamic (in that the components may rotate freely rotate next to each other) and air tight. This prevents air leaks when the user blows through tube 12 and concentrates the pressure charge around the projectile. After blowing through tube 12 and launching soft projectile 50 from blow gun 10, blow gun 10 may be reloaded as before. Loading grip 14 is again rotated approximately a quarter of a turn with respect to receiver 16, until loading chamber 38 is exposed. A new projectile is then loaded into the chamber, and loading grip 14 is rotated back to its ready-to fire position.

Figure 4:
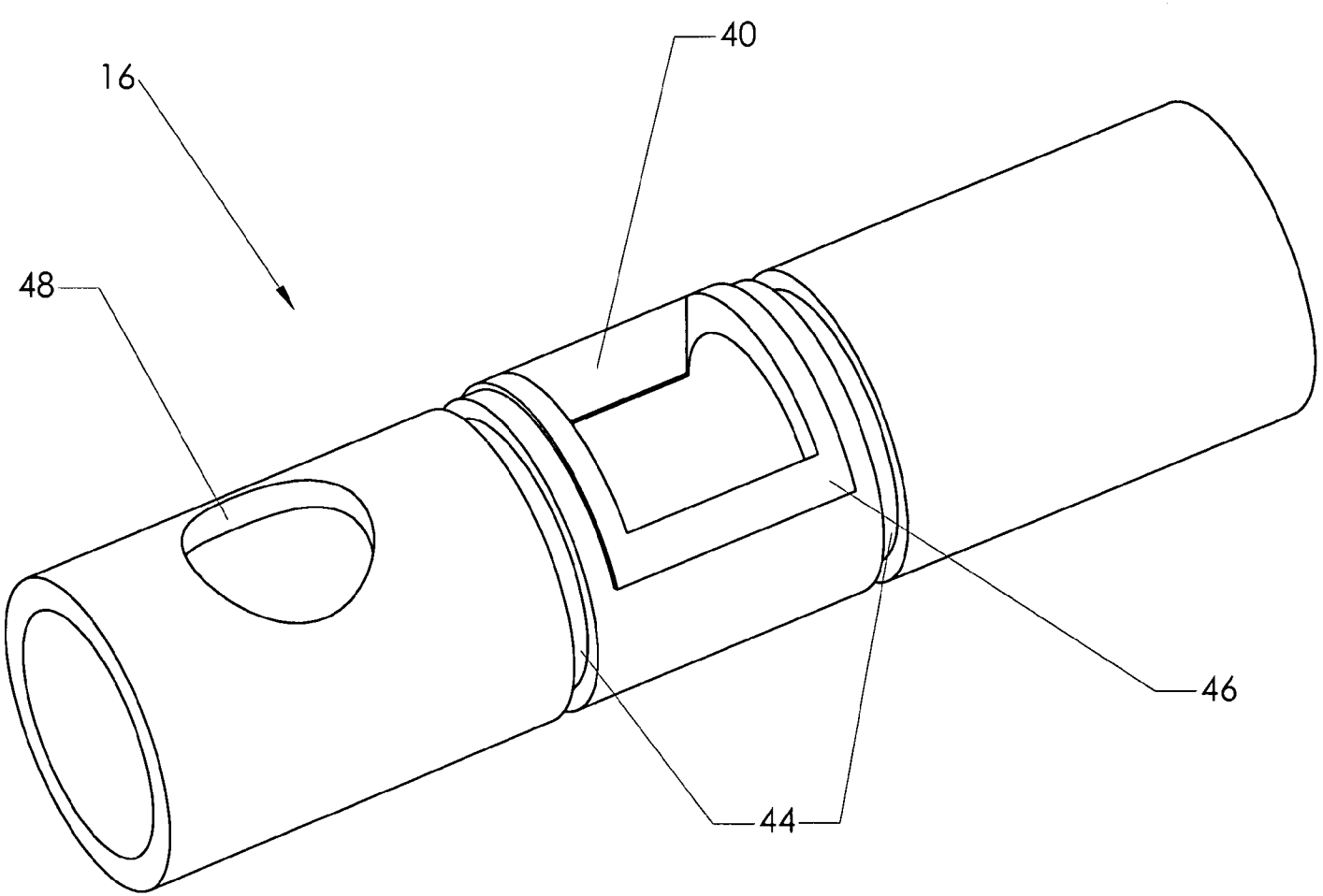
FIG. 4 is a perspective view, showing a receiver.

Receiver 16 is shown in greater detail in FIG. 4. The reader will note that receiver 16 has a substantially cylindrical exterior and a hollow interior. Receiver 16 includes a pair of "O" ring guides 44. "O" ring guide 44 is placed on both sides of receiver port 40 and function to hold "O" rings 42 in place. Spigot port 48 is provided near one end of receiver 16 for receiving spigot 24 and is fluidly connected with the hollow interior of receiver 16. Lip 46 is provided in the surface of receiver 16 around receiver port 40. Lip 46 projects outward from the surface of receiver 16 and mates with the interior surface of action sleeve 18. In the preferred embodiment, action sleeve 18 and receiver 16 are made of plastic. Lip 46 is shaped to create a plastic-on-plastic seal between action sleeve 18 and receiver 16. This further minimizes air leakage when the user blows on tube 12.

The preceding description contains significant detail regarding the novel aspects of the present invention. It should not be construed, however, as limiting the scope of the invention but rather as providing illustrations of the preferred embodiments of the invention. As an example, tube 12 need not be a long flexible tube. Tube 12 may also be a mouthpiece projecting outwardly from receiver 16. Such variations would not alter the function of the invention. Thus, the scope of the invention should be fixed by the following claims, rather than by the examples given.

The invention claimed is:

1. A blow gun for shooting a projectile comprising:

a. a receiver, having a cylindrical exterior, a hollow interior, a first end, a second end, a central axis extending from said first end to said second end within said hollow interior of said receiver, said receiver including i. a first loading port in said cylindrical exterior of said receiver between said first end and said second end, said first loading port opening through said cylindrical exterior, in a direction transverse to said central axis, thereby permitting access to a loading chamber within said hollow interior, said first loading port having a perimeter;

ii. a spigot, said spigot proximal said first end and fluidly connected to said hollow interior of said receiver;

b. an action sleeve, said action sleeve wrapped around said cylindrical exterior of said receiver, said action sleeve configured to rotate around said cylindrical exterior of said receiver and said central axis, said action sleeve having a second loading port opening through said action sleeve in a direction transverse to said central axis;

c. said action sleeve being rotatable between a first position in which said first loading port is aligned with said second loading port, thereby allowing said projectile to be inserted through said first and second loading ports and into said loading chamber, and a second position, in which said first loading port is completely covered by said action sleeve;

d. sealing means between said action sleeve and said receiver for sealing said first port when said action sleeve is rotated to said second position;

e. a barrel connected to said loading chamber;

f. a first handle attached to said action sleeve and extending outward therefrom; and g. a second handle attached to said barrel and extending outward therefrom.

2. The blow gun of claim 1, further comprising a blow tube, having a first end, a second end, and a conduit therebetween, said first end of said blow tube attached to said spigot of said receiver, said blow tube fluidly connected with said hollow interior of said receiver.

3. The blow gun of claim 2, said blow tube further comprising a means for preventing said projectile from passing out said second end of said conduit.

4. The blow gun of claim 3, wherein said means for preventing said projectile from passing through said conduit includes a flow constrictor.

5. The blow gun of claim 1, wherein said sealing means between said action sleeve and said receiver comprises a first O-ring between said action sleeve and said receiver located between said first port and said first end of said receiver, and a second O-ring between said action sleeve and said receiver located between said first port and said second end of said receiver.

6. The blow gun of claim 5, wherein said perimeter of said first port includes a lip extending radially outward in a direction transverse to said axis.

7. The blow gun of claim 6, said action sleeve further comprising a spigot slot for receiving said spigot, said spigot slot being elongated to allow said action sleeve to be rotated from said first position to said second position.

8. The blow gun of claim 1, wherein said barrel has a first end, a second end, and a cylindrical hollow interior therebetween, said first end of said barrel operatively attached to said second end of said receiver such that said hollow interior of said barrel is fluidly connected with said hollow interior of said receiver.

9. The blow gun of claim 8, further comprising a muzzle brake attached to said second end of said barrel, said muzzle brake having an exterior surface, a hollow interior, and a plurality of brake vents opening through said exterior surface into said hollow interior.

10. The blow gun of claim 1, wherein said receiver further comprises a lip in said cylindrical exterior surface around said first loading port, said lip sealing a gap between said cylindrical exterior surface and said action sleeve.

11. A blow gun for shooting a projectile, comprising:

a. a receiver, having a cylindrical exterior surface, a hollow interior, a first end, a second end, a central axis extending from said first end to said second end within said hollow interior of said receiver, said receiver including i. a first loading port extending through said exterior surface in a direction transverse to said central axis, said first loading port opening into a loading chamber within said hollow interior;

ii. a spigot, said spigot proximal said first end of said receiver and fluidly connected to said hollow interior of said receiver;

b. a barrel, said barrel having a first end, a second end, and a cylindrical hollow interior therebetween, said first end of said barrel operatively attached to said second end of said receiver such that said hollow interior of said barrel is fluidly connected with said hollow interior of said receiver;

c. a muzzle brake, said muzzle brake attached to said second end of said barrel, said muzzle brake having an exterior surface, a hollow interior, and a plurality of brake vents opening through said exterior surface into said hollow interior;

d. an action sleeve, said action sleeve wrapped around said cylindrical exterior of said receiver, said action sleeve configured to rotate around said cylindrical exterior of said receiver and said central axis, said action sleeve having a second loading port opening through said action sleeve in a direction transverse to said central axis;

e. said action sleeve being rotatable between a first position in which said first loading port is aligned with said second loading port, thereby allowing said projectile to be inserted through said first and second loading ports and into said loading chamber, and a second position, in which said first loading port is completely covered by said action sleeve;

f. sealing means between said action sleeve and said receiver for sealing said first port when said action sleeve is rotated to said second position;

g. a first handle attached to said action sleeve and extending outward therefrom; and h. a second handle attached to said barrel and extending outward therefrom.

12. The blow gun of claim 11, further comprising a blow tube, having a first end, a second end, and a conduit therebetween, said first end of said blow tube attached to said spigot of said receiver, said blow tube fluidly connected with said hollow interior of said receiver.

13. The blow gun of claim 12, said blow tube further comprising a means for preventing said projectile from passing through said conduit.

14. The blow gun of claim 11, wherein said sealing means between said action sleeve and said receiver comprises a first O-ring between said action sleeve and said receiver located between said first port and said first end of said receiver, and a second O-ring between said action sleeve and said receiver located between said first port and said second end of said receiver.

15. The blow gun of claim 14, further comprising a lip surrounding said first loading port, said lip extending radially outward in a direction transverse to said axis.

16. The blow gun of claim 11, said action sleeve further comprising a spigot slot for receiving said spigot, said spigot slot configured to allow said action sleeve to be rotated from said first position to said second position.

* * * * *